US005091995A

United States Patent [19]

Oates

[11] Patent Number: 5,091,995

[45] Date of Patent: Mar. 3, 1992

[54] SPORTS CAP

[76] Inventor: Kenneth W. Oates, 3915 Mission Blvd., San Diego, Calif. 92109

[21] Appl. No.: 564,780

[22] Filed: Aug. 10, 1990

[51] Int. Cl.[5] ..... A42B 1/06

[52] U.S. Cl. ..... 2/195; 2/10; 2/171.1; 2/197; 2/199; 2/209.1

[58] Field of Search ..... 2/10, 12, 15, 171, 171.1, 2/171.2, 185 R, 195, 196, 197, 199, 209.1, 209.5, 410, 417, 418, 419, 420

[56] References Cited

U.S. PATENT DOCUMENTS

| | | | |
|---|---|---|---|
| D. 237,758 | 11/1975 | Huffman | 2/199 |
| 1,677,187 | 7/1928 | Leibson | 2/10 |
| 2,446,053 | 7/1948 | Matarazzo | 2/197 |
| 4,023,212 | 5/1977 | Huffman | 2/171.1 |
| 4,547,903 | 10/1985 | Brown | 2/199 |
| 4,630,317 | 12/1986 | Brown | 2/199 |
| 4,850,049 | 7/1989 | Landis | 2/10 |
| 4,873,726 | 10/1989 | Tapia | 2/10 |
| 4,989,270 | 2/1991 | Boughten | 2/199 |

FOREIGN PATENT DOCUMENTS

| | | | |
|---|---|---|---|
| 637556 | 5/1928 | France | 2/10 |
| 17570 | of 1893 | United Kingdom | 2/195 |
| 2070413 | 9/1981 | United Kingdom | 2/209.1 |

*Primary Examiner*—Werner H. Schroeder
*Assistant Examiner*—Diana L. Biefeld
*Attorney, Agent, or Firm*—George J. Rubens

[57] ABSTRACT

A sports cap is fabricated to provide maximum sun and wind protection to the face, ears, and neck of the wearer during use in land, and especially in water activities. These unique results are achieved by constructing the cap with a crown having front and rear brims. The rear brim may be made detachable from the crown, and used independently as a front visor or be attached to the rear portion of any other cap or hat. The brims are made from a mesh material with variable density and maintained in shape by a tensioned flexible rod secured along their periphery. The mesh material reduces resistance to wind and water, minimizing loss of the cap during very active use, and filters the passage of light. When the cap is applied to the head the tensioned rods enable the front brim to be flexed either to an upper position for an unobstructed field of vision, or flexed to the lower normal position for maximum sun and wind protection. The cap may contain a buoyant material to keep it afloat in water.

18 Claims, 2 Drawing Sheets

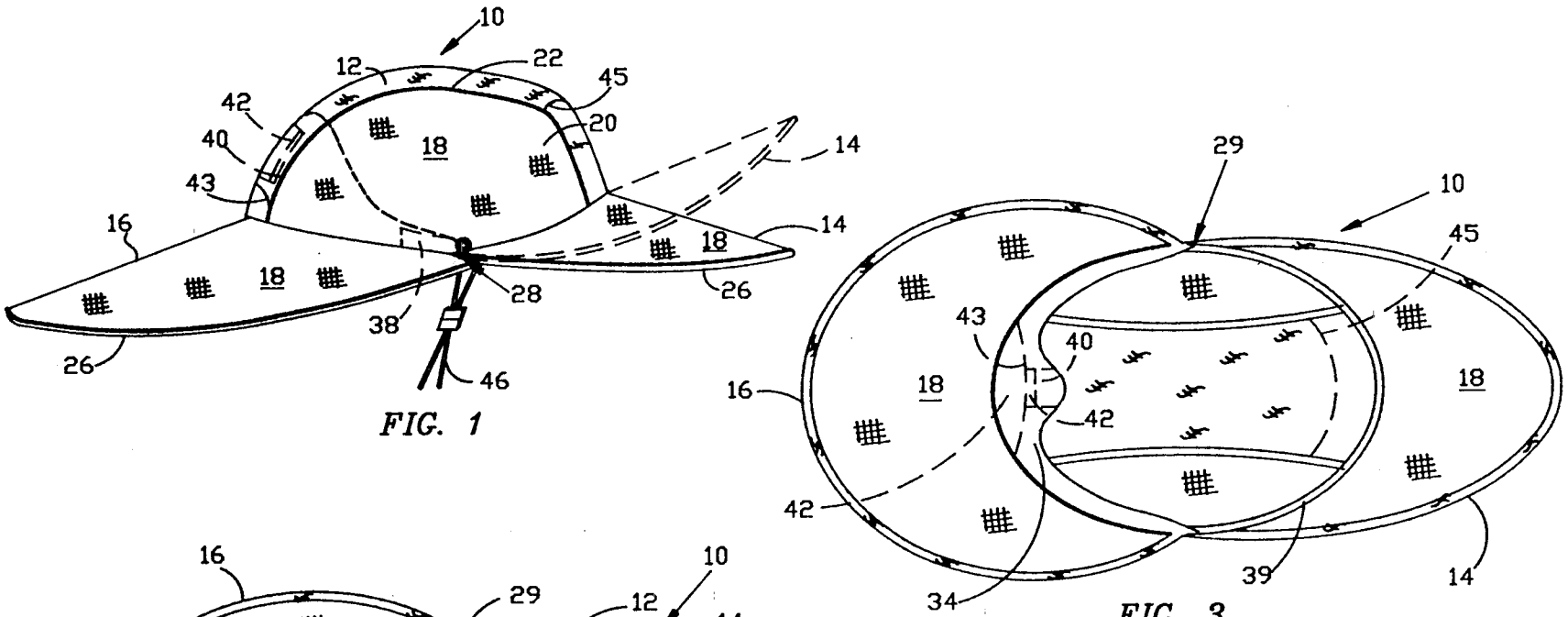
FIG. 1
FIG. 3
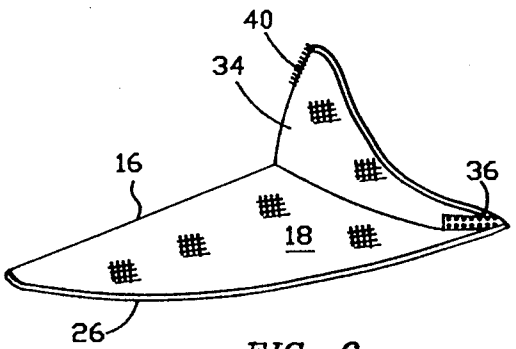
FIG. 6
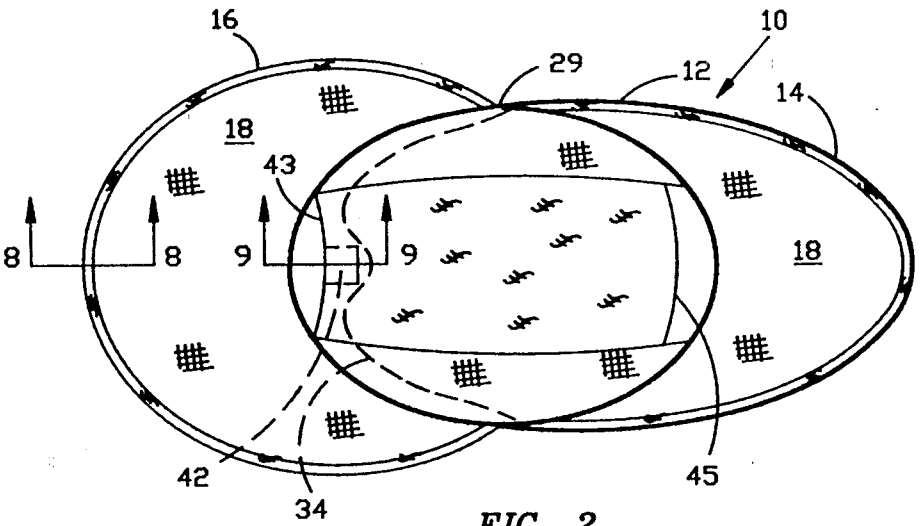
FIG. 2

SPORTS CAP

PREAMBLE

This invention relates to caps, and more particularly to a unisex cap having front and rear brims to provide maximum sun and wind protection to the face, ears and neck of the user during land and, especially in water sports activities.

There have been numerous cap designs that have been produced over the years for sports-minded participants. Almost all of these caps are of the baseball-type having a crown and a front brim or visor, the brims being invariably made of cloth material having an intermediate cardboard stiffener. Caps of this type can be distinguished from hats, which have a continuous brim encircling the crown. Baseball caps offer no protection for the neck and ears of the user. In addition, the solid non-perforated front brim presents a sail surface to the wind and water, especially during such activities as surfing, wind surfing, or sailing, and can cause the loss of the cap. As these prior art baseball brims were fixed in position with respect to the cap crown, they limited the user's upward and peripheral vision, especially important in certain sport activities such as surfing.

The present invention provides a unisex sports cap having a central crown with attached front and rear brims to provide sun and wind protection for the neck and ears of the wearer, as well as the face. Making the brims of a flexible, open mesh material reduces its resistance to wind and water while allowing the passage of filtered light.

The shape of the brims are maintained by thin tensioned rods along their periphery, which enables the front brim to be flexed to an upper position allowing unobstructed field of vision, and be flexed to a lower shade position. The cap may be fabricated with a buoyant material to float in water and be readily retrievable.

BRIEF SUMMARY OF THE INVENTION

A novel unisex sports cap is fabricated with a central crown having attached front and rear brims that offer maximum sun and wind protection to the face, ears and neck of the user. The rear brim can be made detachable to be interchanged with other brim shapes or attached to other caps or hats, and when separated from the crown can be provided with a strap so that the rear brim can be used separately as a front visor without the crown. The front and rear brims are fabricated of a mesh material allowing passage of wind and water as well as filtered light. The brims are rimmed with a thin tensioned rod to provide a semi-rigid frame for the mesh material. When the cap is worn, the tensioned rod in the front brim can bias it to an upper position to afford the wearer maximum field of vision. The front brim can also be flexed downward to a normal maximum shade position. The front and rear brims can overlap at their intersection at the sides of the crown to provide a protective sun shade over the ears of the user. The means for detachably connecting the rear brim to the crown is adjustable to allow the size of the cap to be varied as well as the height of the crown. A segment of the crown can be constructed of a buoyant material so that the cap will float and be readily retrievable from water. The cap is provided with a chin strap to prevent accidental dislodging from the user's head during use, and it can be swung over either brim for storage when not needed.

OBJECTS OF THE INVENTION

A principal object of the invention is to provide a sports cap having front and rear brims that offer wind and sun protection to the face, neck, and ears of the wearer.

A further object is to enable the rear brim to be detached and used as a front crownless visor, or attached to the rear portion of a conventional hat or cap to protect the neck of the user.

A further object is to enable the rear brim to be replaceable with other styles or shapes to satisfy the needs of the user.

Another important object is to fabricate the front and rear cap brims of an open mesh material to reduce the weight of the cap and offer less resistance to wind and water by allowing partial passage therethrough.

Still another object is to support the open flexible mesh material by a thin, flexible, tensioned rod around its periphery which can bias the front brim to a fixed upper position to allow unobstructed field of vision, or to a lower normal position where the brim offers maximum shade.

A further object is to fabricate the cap crown with a buoyant material to enable the cap to float in water and be readily retrievable.

Another object of the invention is to vary the number of layers and therefore the density of the open mesh material in various segments of the crown and brims to regulate the passage of wind, water, and sunlight.

A further object of the invention is to enable the wearer a degree of visibility through the mesh material of the front brim.

Another principal object of the invention is to enable variable sizing of the circumference and height of the crown in conjunction with attachment of the rear brim to the crown.

Still another object of the invention enables the cap to be worn, without the rear brim, as a baseball-type cap.

A further object of the invention enables it to be rotated 180 degrees and worn with the larger rear brim to the front for increased shading of the face.

Still another important object of this invention is to provide a sports cap with separable components that can be used in a variety of different ways to enhance its versatility to the user.

DESCRIPTION OF THE FIGURES

FIG. 1 is a side elevation view of the novel unisex sports cap showing front and rear brims attached to the cap crown.

FIG. 2 is a top plan view of the cap in FIG. 1.

FIG. 3 is a bottom plan view of the cap in FIG. 1.

FIG. 6 is a side elevation view of detached rear brim of FIG. 1.

DETAILED DESCRIPTION OF THE INVENTION

Figure 7:
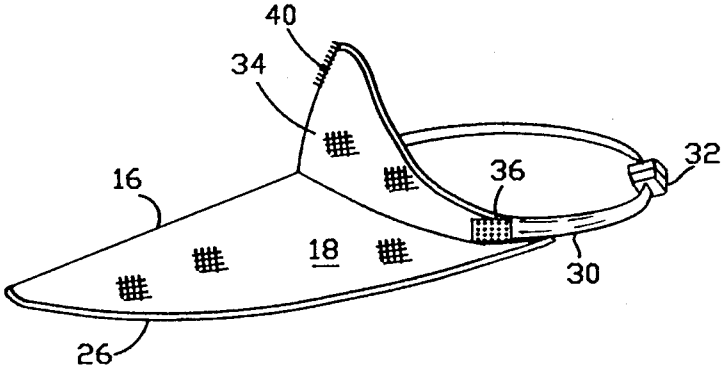
FIG. 7 is a side elevation view of the detached rear brim of FIG. 6 with a strap attached to enable the rear brim to be used as a front visor without the cap crown.

Referring to the drawing where like reference numbers refer to the same parts throughout the figures, there is shown in FIGS. 1-3, a novel unisex sports cap 10 having a central crown 12 and attached thereto a front brim 14 and a rear brim 16, which brims function to protect the face, ears, and neck of the user from the sun and wind. An important feature of the invention is to fabricate brims 14, 16 of a flexible open mesh material 18, preferably of nylon or polyester, and if desired, also in both sides 20 of the crown 12. The central crown portion 22 is preferably made of an opaque fabric to shade the top of the user's head. Mesh material 18 provides several unique advantages, especially where the cap is used in more active land and water sports such as biking, sailing, windsurfing, and surfing, in that the material presents a minimum resistance allowing the passage of wind and water, thereby reducing the likelihood of loss during such activities. In addition the mesh material reduces the weight of the cap and is more durable. The amount of light transmitted through the mesh material can be controlled by varying its density through the number of layers of mesh employed or the size of the mesh openings.

Figure 8:
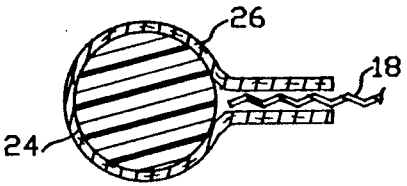
FIG. 8 is a partial cross section of the rear brim taken along line 8—8 of FIG. 2 showing the means for securing the peripheral supporting rod to the flexible mesh material of the front and rear brims.

The configuration of each brim 14, 16 is maintained by using a small flexible rod 24 sewn into the peripheral hem 26 of the flexible mesh material 18 as is best shown in FIG. 8. Rod 24 is preferably made of flexible plastic, and is pretensioned when sewn into the hem 26 around the periphery of the brim. When the cap is worn by the user, the pressure on the front brim 14 enables it to be flexed to an upper position shown in broken lines in FIG. 1, to allow unobstructed field of vision, especially important for safety in sports such as surfing. The front brim can be readily flexed down to its normal shade position shown in solid lines in FIG. 1. As shown in FIGS. 1-3, the front and rear brims are configured and constructed so as to overlap at their intersection 28 to provide a protective sun shield over the ears of the wearer.

Figure 5:
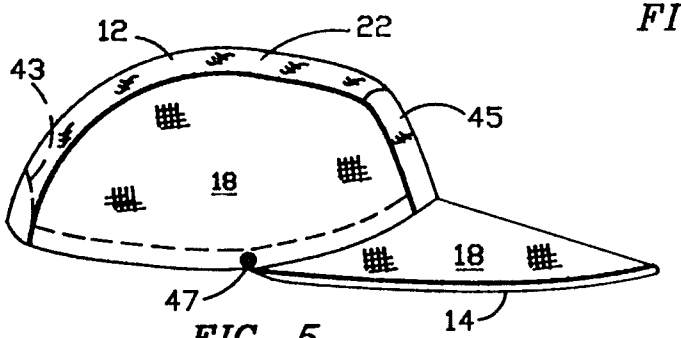
FIG. 5 is a side elevation view of the cap similar to FIG. 1 with the rear brim detached.

Rear brim 16 can be integrally attached to the rear of the cap crown 12, but preferably is constructed to be detachable as shown in FIGS. 5-7. Detachability of rear brim 16 offers several advantages in that it can be removed when desired; can be interchanged with other differently-styled brims; and, as shown in FIG. 7, can be provided with a removable "VELCRO"-tipped strap 30 and adjustment device 32 to enable rear brim 16 to be used as a front visor without crown 12. Another important use of the detached rear brim is its attachment to other conventional caps as well as hard hats to protect the necks and ears of construction workers.

Figure 9:
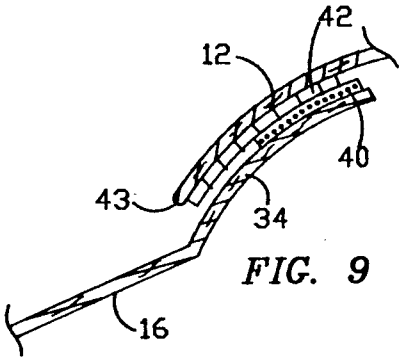
FIG. 9 is a partial cross section of the cap crown and rear brim taken along 9—9 of FIG. 2 showing the means for securing the detachable rear brim to the cap crown and also for adjusting the height of the crown with respect to the top of the user's head.
Figure 4:
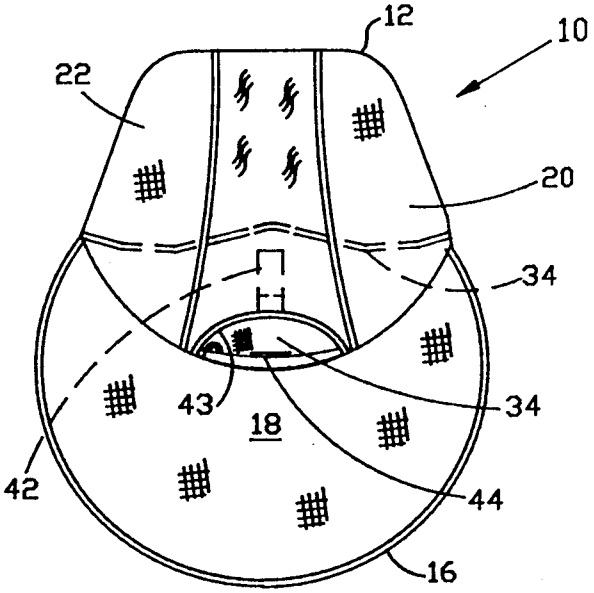
FIG. 4 is a rear elevation view of the cap in FIG. 1.

When rear brim 16 is made detachable from the crown 12, as best illustrated in FIGS. 6, 7, and 9, the rear brim is provided with an upwardly extending arcuate extension 34, which is provided with "VELCRO" strips 36 on each side adapted to engage corresponding "VELCRO" strips 38 (FIG. 1) that are attached on the inside of the crown 12 along the temple areas of sweatband 39. The top center of the rear brim extension 34 is also provided with a "VELCRO" strip 40 adapted to engage a corresponding "VELCRO" strip 42 sewn inside the rear center of the crown (see FIGS. 2 & 9). The corresponding pairs of "VELCRO" strips 36, 38, 40, & 42 are of suitable length to enable lateral adjustment between rear brim 16 and crown 12. "VELCRO" strips 40 & 42 enable the height of the crown to be adjusted to the head of the user. "VELCRO" component strips 36 to 40 can also be used to secure the detachable rear brim to a conventional hat, such as a construction hard-hat, not shown, to protect the neck of the worker. A conventional lock fastener 44 is provided at the rear of the cap for adjusting cap size and extends across a cut-out section 43 in the rear portion of the crown.

The novel sports cap can be provided with a conventional adjustable chin strap 46 which can be swung over the front or rear brim for storage when not needed. A buoyant material can be incorporated into segment 45 of the crown 12 or in sweatband 39 to facilitate recovery should the cap be lost during water activities.

The novel sports cap of this invention for the first time provides sun and wind protection for the face, ears, and neck of the user by incorporating front and rear brims on the cap crown while providing a means for varying the size circumference and height of the cap crown. Possible loss of the cap during very active sports activities is minimized by fabricating the front and rear brims of a lightweight, durable, flexible open mesh material which reduces resistance to wind and water while allowing filtered light. The flexible pretensioned rods incorporated in the periphery of the brims maintains the shape of the flexible mesh material, and enables the front brim to be flexed upward to a fixed position for clear and unobstructed field of vision, especially important for safety reasons in such activities as surfing and windsurfing. For normal use the front brim can be flexed downward to a maximum shade position.

Another important feature of the sports cap is the detachable rear brim which allows for variable sizing and height of the cap. The rear brim can be separated from the cap when not needed, and can be interchanged with other styles of rear brims or attached to other types of caps or hats as desired by the user, and also, can be used as a front visor without the cap crown. Thus, the versatility in usage of the cap and its components enhances its value to the user.

I claim:

1. A sports cap having a crown with front and rear brims attached thereto; said brims made of a flexible, open mesh material to enable the passage of wind and water therethrough to minimize loss of the cap during sports activities; and a rod secured along the periphery of each brim to the mesh material to maintain the shape of the brims.

2. The sports cap of claim 1 wherein said rod is flexible and under tension for biasing the brims when the cap is worn by the user, either to a normal lower position to provide maximum shade, or to an upper position to increase the wearer's field of vision.

3. The sports cap of claim 1 wherein means are provided for detachably mounting said rear brim to the cap crown or to the crowns of other caps or hats.

4. The sports cap of claim 3 wherein said rear brim is provided with a detachable strap to allow the rear brim to be used as a visor separate from the cap crown.

5. The sports cap of claim 3 wherein the means for detachably mounting the rear brim to the cap crown is adjustable to enable the size of the crown to be changed.

6. The sports cap of claim 5 where the adjustable means for securing the rear brim to the crown is secured by means of "VELCRO" strips.

7. The sports cap of claim 1 wherein an adjustable chin strap is provided to secure the cap on the head of the wearer and of such a length as to be extended over and stored of either brim when not in use.

8. The sports cap of claim 1 wherein the crown of the cap contains a buoyant material to enable the cap to float in water.

9. The sports cap of claim 1 wherein the sides of the cap crown are fabricated of open mesh material, and the top of the crown is made of opaque fabric.

10. The sports cap of claim 1 wherein the sides of the front and rear brims overlap at their intersection to provide a protective cover for the ears of the wearer.

11. A sports cap having a crown with front and rear brims attached thereto; said brims made of an open mesh material to enable the passage of wind and water to minimize loss of the cap during sports activities; a pretensioned flexible rod secured along the periphery of each brim to the mesh material to maintain the shape of the open mesh material so that when the cap is worn by the user the front brim can be flexed to an upper position to afford maximum field of vision to the user, or to a lower normal position to offer maximum shade protection.

12. The sports cap of claim 11 wherein said front and rear brims overlap at their intersection at the sides of the crown to provide a sun shade over the ears of the user.

13. The sports cap of claim 11 wherein means are provided for detachably mounting said rear brim to the crown of the cap.

14. The sports cap of claim 11 wherein said detachable means is adjustable to enable the size of the cap to be varied.

15. The sports cap of claim 14 wherein adjustable means are provided to vary the height of the cap crown with respect to the head of the user.

16. A protective head covering having a crown, a front brim, and a rear brim for protecting the neck and ears of the user from the effects of sun and wind, said brims intersecting to form overlapping portions to cover the ears of the user, means for adjusting the size of the crown, said rear brim having adhering means for securing detachably the rear brim to the crown to enable its adjustability, whereby the rear brim when detached can be used as a brim independently of the crown, and be adhered to other head coverings.

17. The head covering of claim 16 wherein separate means are provided for adjusting the size and height of the crown.

18. The rear brim of claim 16 wherein is provided a strap to allow its use as a front visor without a crown.

* * * * *